US007357469B2

(12) United States Patent
Ertz

(10) Patent No.: US 7,357,469 B2
(45) **Date of Patent: *Apr. 15, 2008**

(54) ARTICLE RETAINER ASSEMBLY FOR REFRIGERATORS

(75) Inventor: Lawrence J. Ertz, Amana, IA (US)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/707,107

(22) Filed: Feb. 16, 2007

(65) Prior Publication Data

US 2007/0228910 A1 Oct. 4, 2007

Related U.S. Application Data

(63) Continuation-in-part of application No. 11/390,387, filed on Mar. 28, 2006, now Pat. No. 7,198,340.

(51) Int. Cl.
*A47B 96/02* (2006.01)

(52) U.S. Cl. ..... 312/408; 211/119.003

(58) Field of Classification Search ..... 312/401, 312/405.1, 408, 410, 291; 108/6; 62/377, 62/382; 211/134, 149, 153, 119.003
See application file for complete search history.

(56) References Cited

U.S. PATENT DOCUMENTS

| | | | | |
|---|---|---|---|---|
| 2,074,785 | A | 3/1937 | Gentz | |
| 2,091,607 | A | 8/1937 | Nave | |
| 2,319,470 | A | 5/1943 | Nobles | |
| 2,434,117 | A | 1/1948 | Money et al. | |
| 2,757,061 | A | 7/1956 | Anderson | |
| 2,767,042 | A | 10/1956 | Kesling | |
| 2,828,178 | A | 3/1958 | Dahlgren | |
| 2,976,101 | A | 3/1961 | Rooney | |
| 3,388,808 | A | 6/1968 | Radek | |
| 3,625,371 | A | 12/1971 | Dill | |
| 3,827,574 | A * | 8/1974 | Craig, Sr. | 211/184 |
| 3,851,765 | A | 12/1974 | Cox | |
| 4,437,572 | A | 3/1984 | Hoffman | |
| 4,492,169 | A | 1/1985 | Ware et al. | |
| 4,500,147 | A | 2/1985 | Reister | |
| 4,610,491 | A | 9/1986 | Freeman | |
| 5,513,910 | A | 5/1996 | Ellingwood et al. | |
| 5,567,029 | A | 10/1996 | Haenisch et al. | |

(Continued)

FOREIGN PATENT DOCUMENTS

| | | |
|---|---|---|
| GB | 2099124 | 12/1982 |

*Primary Examiner*—James O. Hansen
(74) *Attorney, Agent, or Firm*—Michael D. Lafrenz; Kirk Goodwin

(57) ABSTRACT

An article retainer assembly for a refrigerator shelf includes a pair of support brackets and a retaining member. The support brackets are preferably mounted at opposing side portions of a refrigerator shelf, with the retaining member extending therebetween and across a front edge section of the shelf. The support brackets include corresponding guide tracks having first and second portions adapted to support the retaining member in an upright, lowered or stowed configuration. In the upright position, the retaining member prevents articles resting upon the shelf from moving beyond the front edge section. In the lowered position, unobstructed access is provided to the articles on the shelf and, in the stowed position, the retaining member is held in place below the shelf.

19 Claims, 6 Drawing Sheets

U.S. PATENT DOCUMENTS 6,220,684 B1 4/2001 Bent et al.
6,390,310 B1 5/2002 Insalaco
6,799,818 B2 10/2004 Ahmed et al.
6,997,526 B2 2/2006 Leimkuehler et al.
7,111,914 B2 9/2006 Avendano et al.
D544,261 S * 6/2007 Nawrocki ..... D6/511
2005/0082956 A1 4/2005 Leistner et al.

* cited by examiner

ARTICLE RETAINER ASSEMBLY FOR REFRIGERATORS

CROSS-REFERENCE TO RELATED APPLICATIONS

The present application constitutes a continuation-in-part of U.S. patent application Ser. No. 11/390,387, filed Mar. 28, 2006, now U.S. Pat. No. 7,198,340.

BACKGROUND OF THE INVENTION

1. Field of the Invention

The present invention pertains to the art of refrigerators and, more particularly, to a movable front retainer assembly for a refrigerator shelf.

2. Discussion of the Prior Art

It is known to provide a refrigerator shelf with a tilt-down front retaining member. It is also known to provide a freezer shelf with a retaining member that can be shifted from an article retaining position to allow enhanced access to articles on the shelf. Therefore, such front is retainers securely retain articles on the shelves, while also providing a user easy access. In most cases, the retaining member is pivoted forward from an initial, upright position, to a second or lowered position. Although useful from an organizational standpoint, when in the lowered position, the retaining member may block a user from readily accessing items stored on lower shelves. In most cases, a special liner construction is required in order to accommodate this type of retaining member. That is, the liner is generally provided with structure designed to hold the retaining member in the upright position.

Other retaining members are removable and, when installed, can be pivoted from an upright position to a lowered position wherein the retaining member is substantially coplanar with the shelf. This type of retaining member allows a user to configure the retaining member to establish a conventional flat shelf or, alternatively, define product retaining structure. However, retaining members of this type generally project beyond the shelf when moved to the lowered position, often preventing the refrigerator door from closing properly and/or damaging the door if it is closed.

Regardless of these known arrangements, there is still a need in the art for an enhanced shelf retaining member. More specifically, there exists a need for a shelf retaining member that can be employed to retain articles on a shelf or be stowed for later use while still providing sufficient clearance for closing a refrigerator door and allowing access to articles located below the shelf. Furthermore, there exists a need for a retaining member that is easily installed into pre-existing refrigerator structures.

SUMMARY OF THE INVENTION

The present invention is directed to an article retainer assembly for a shelf in a refrigerator including a cabinet shell within which is positioned a liner having top, bottom and opposing side walls that define, at least in part, a refrigerated compartment. The shelf is positioned in the refrigerated compartment for supporting articles to be refrigerated. The shelf includes a generally upper planar portion defined, at least in part, by a front edge section. In accordance with the invention, the article retainer assembly extends across the front edge section of the shelf. The retaining member can be readily shifted between an upright position, a lowered position and a stowed position. In the upright position, the retaining member blocks the articles supported on the shelf from moving beyond the front edge section. In the lowered position, the retaining member exposes the articles on the shelf, allowing for easy retrieval by a consumer. When not needed the retaining member is shifted to the stowed position wherein the retaining member is held under the upper planar portion for later use.

In a first embodiment, the article retainer assembly includes a pair of support brackets mounted to the opposing side walls of the liner and a retaining member. Each of the support brackets includes a guide track. The guide track has first, second and third portions that correspond to the upright, lowered and stowed positions. More specifically, the retaining member is provided with first and second support elements that project laterally outward from the retaining member into the guide track of corresponding ones of the support brackets. In addition, at least one of the support brackets includes a clip element that cooperates with the retaining member. The clip element holds the retaining member adjacent an underside of the shelf when in the stowed position.

In a second embodiment, the article retainer assembly includes a pair of support brackets adapted to clip onto a refrigerator shelf and provide support for a retaining member. Each of the support brackets includes a guide track that allows the retaining member to transition between upright, lowered and stowed positions. More specifically, the retaining member is provided with first and second pivot posts that project laterally outward into a corresponding guide track of a respective one of the support brackets. In addition, the retaining member includes at least one peg. The peg extends laterally outward from an upper portion of the retaining member. Preferably, the peg cooperates with a clip element provided on at least one of the support brackets to hold the retaining member substantially parallel with, and beneath, the shelf when in the stowed position.

Additional objects, features and advantages of the present invention will become more readily apparent from the following detailed description of preferred embodiments when taken in conjunction with the drawings wherein like reference numerals refer to corresponding parts in the several views.

DETAILED DESCRIPTION OF THE PREFERRED EMBODIMENT

Figure 1:
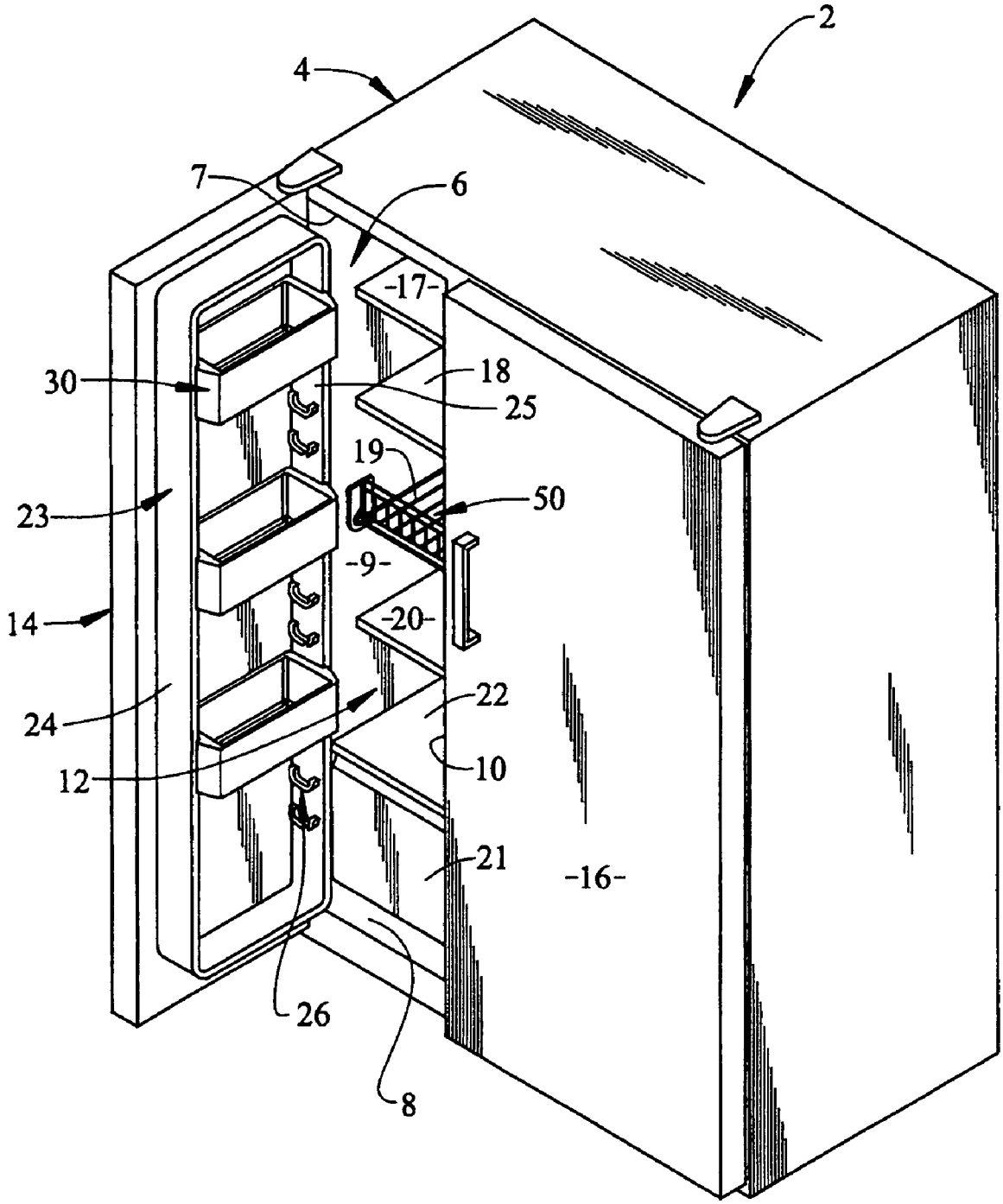
FIG. 1 is an upper left perspective view of a side-by-side refrigerator illustrating an article retaining assembly constructed in accordance with a first embodiment of the present invention positioned across a freezer compartment shelf.

With initial reference to FIG. 1, a side-by-side refrigerator 2 includes a cabinet shell 4 within which is positioned a liner 6 having top, bottom and opposing side walls 7-10 that define, at least in part, a freezer compartment 12. In a manner known in the art, freezer compartment 12 can be accessed by the selective opening of a freezer door 14. In a similar manner, a fresh food door 16 can be opened to access a fresh food compartment (not shown). As illustrated in FIG. 1, freezer compartment 12 is provided with a plurality of vertically adjustable spaced shelves 17-20, along with a slidably mounted bin 21 supported below a stationary shelf 22. Also illustrated is a freezer door liner 23 including dike portions 24 and 25 formed with vertically spaced mounting supports, one of which is indicated at 26. Mounted between dike portions 24 and 25 and suspended by supports 26 are a plurality of pick-off bucket assemblies, one of which is indicated at 30. In general, the basic structure of refrigerator 2 described above is known in the art and presented only for the sake of completeness.

Figure 2:
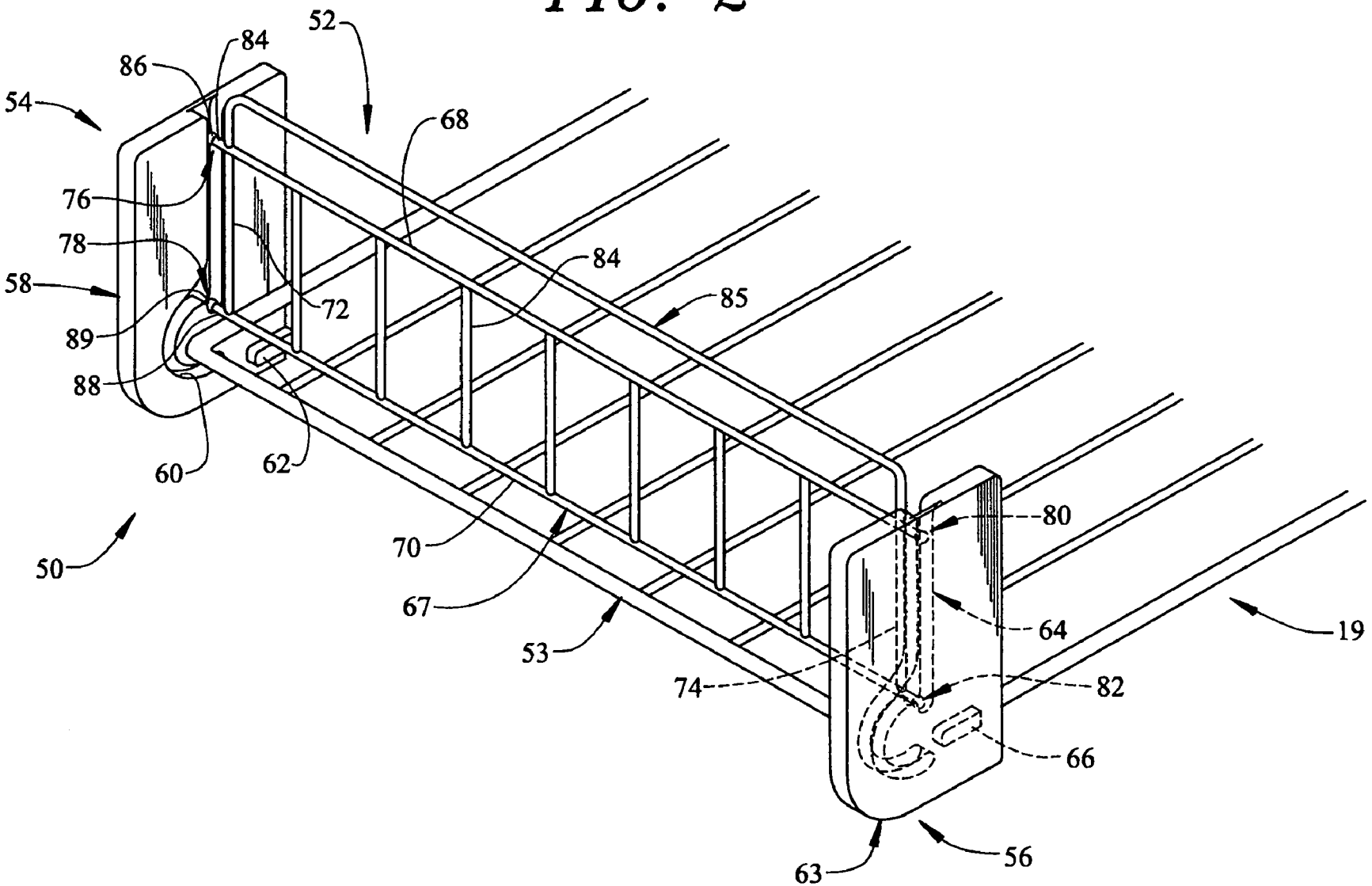
FIG. 2 is an upper left perspective view of the article retaining assembly of FIG. 1, illustrating first and second support brackets and a retaining member of the retaining assembly.

A first embodiment of the present invention will now be discussed with reference to FIGS. 1 and 2. Shelf 19 is provided with an article retainer assembly 50 including a retaining member 52 that extends across a front edge section 53 of shelf 19 and is supported by first and second support brackets 54 and 56 which are secured to opposing side walls 9 and 10 respectively. Support brackets 54 and 56 can be mounted with, for example, adhesive pads, glue, mechanical fasteners or the like. In accordance with the first embodiment of the present invention, first bracket 54 includes a main body portion 58, having formed thereon a guide track 60, and a holding element 62. Preferably, guide track 60 is recessed into main body portion 58, while holding element 62 projects laterally outward therefrom. Likewise, second bracket 56 includes a main body portion 63 having formed therein a corresponding guide track 64 and a holding element 66. In the embodiment shown, shelf 19 is formed from a plurality of wire elements (not separately labeled). However, it should be understood that shelf 19 could also be solid, such as by being formed from plastic and/or glass.

Retaining member 52 is preferably formed from coated wire and includes a main body portion 67 having a top section 68, a bottom section 70 and first and second opposing side sections 72 and 74. Retaining member 52 includes a first guide element 76 that projects from top section 68 beyond side section 72 and a pivot post 78 that extends from bottom section 70 beyond side section 72. Retaining member 52 also includes a second guide element 80 that projects from top section 68 beyond side section 74 and a second pivot post 82 that extends from bottom section 70 beyond side section 74. Guide elements 76 and 80 and pivot posts 78 and 82 project into and travel along guide tracks 60 and 64 respectively in a manner that will be discussed more fully below.

In accordance with the first embodiment, retaining member 52 is shown to include a plurality of intermediate members, such as indicated at 84, that extend between and interconnect top and bottom sections 68 and 70. Retaining member 52 is also shown to include an upper U-shaped bar 85. In any event, it should be understood that guide elements 76 and 80, pivot posts 78 and 82 and guide tracks 60 and 64 are respectively, similarly constructed such that a discussion will continue with respect to guide element 76, pivot post 78 and guide track 60 with an understanding that the opposing guide element 80, pivot post 82 and guide track 64 are similarly arranged. As shown, guide element 76 includes a shaft portion 84 that terminates in a head portion 86, with head portion 86 nesting within guide track 60. Likewise, pivot post 78 includes a shaft portion 88 which terminates in a head portion 89 which also nests within guide track 60. In a manner that will be discussed more fully below, guide element 76 and pivot post 82 transition along guide track 60, allowing retaining member 52 to be selectively shifted between a first or upright position as represented in FIGS. 2-4, a second or lowered position as represented in FIG. 5, and a third or stowed position as represented in FIG. 6.

Reference will now be made to FIGS. 3-6 in describing a preferred construction of guide track 60. In order to provide for the transitioning of retaining member 52, guide track 60 is formed with first, second and third portions 100, 102 and 104. First portion 100 includes a first end 110 that extends to a second end 111 through an intermediate portion 112. As will be discussed more fully below, first end 110 is exposed at an upper portion (not separately labeled) of support bracket 54. Second portion 102 extends from and actually connects with first portion 100. Towards that end, second portion 102 is provided with a first end 116 that extends towards a second end 118 through an arcuate intermediate portion 120. Preferably, first end 116 is positioned at a point off-set from second end 111 of first portion 100 such that second end 111 actually defines a notch. This configuration ensures that, as will be discussed more fully below, guide element 76 and pivot post 78 must initially be raised upward along first portion 100 before pivot post 78 can enter into second portion 102. Finally, third portion 104 is actually a terminal end section or continuation of second end 118. As illustrated, first portion 100, second portion 102 and third portion 104 are directly interconnected. By interconnected, it should be understood that first portion 100, second portion 102 and third portion 104 form a continuous path.

Figure 3:
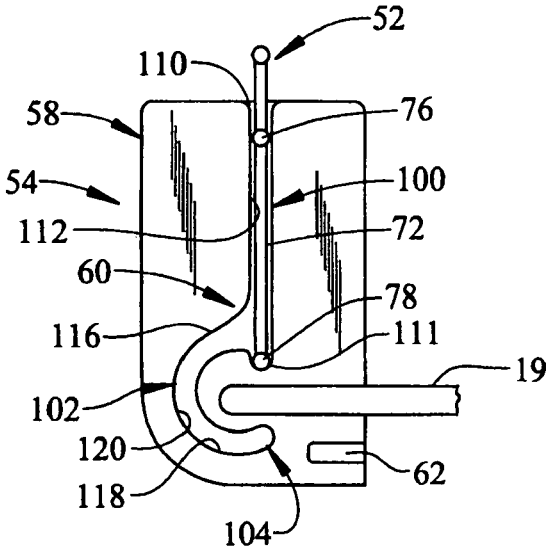
FIG. 3 is a side elevational view of one support bracket of the article retaining assembly of the first embodiment, illustrating the retaining member in a first or upright position.
Figure 4:
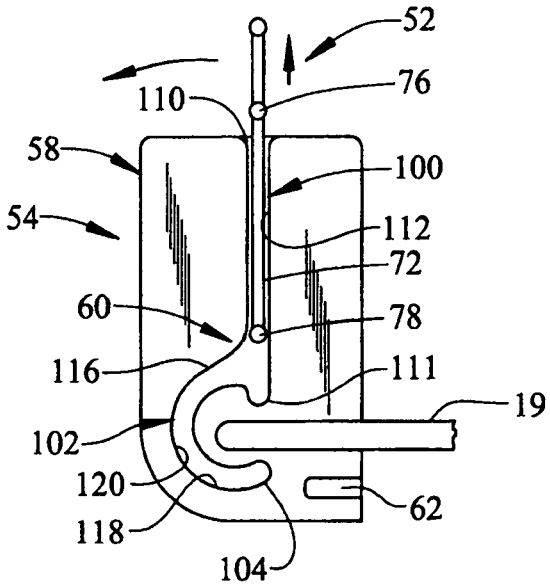
FIG. 4 is a side elevational view of one support bracket of the article retaining assembly of the first embodiment, illustrating the retaining member shifting towards a second or lowered position.
Figure 5:
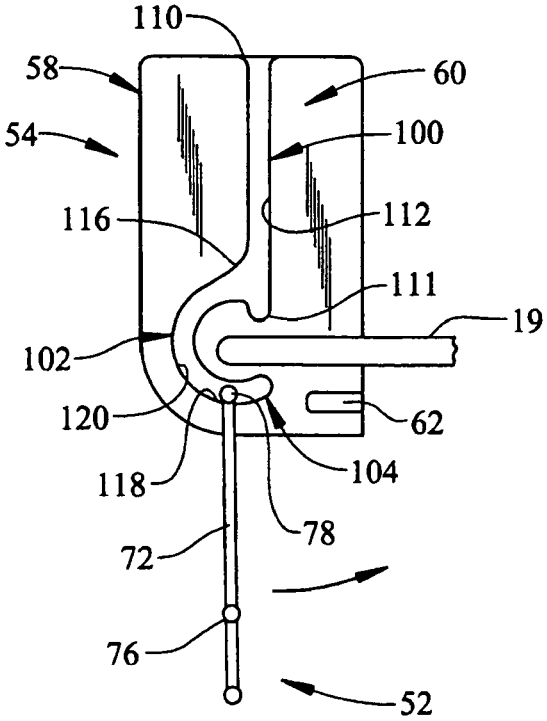
FIG. 5 is a side elevational view of one support bracket of the article retaining assembly of the first embodiment, illustrating the retaining member in the second or lowered position.

Having described a preferred structure of article retainer assembly 50, reference will continue to FIGS. 3-6 in describing a preferred method of operation. As best shown in FIG. 3, retaining member 52 is shown in a first or upright position. In the upright position, retaining member 52 is positioned substantially perpendicular to shelf 19 so as to effectively block or prevent articles resting upon shelf 19 from moving beyond front edge portion 53. In order to remove an article from shelf 19, a consumer need simply shift retaining member 52 from the upright position to a lowered position as detailed below. More specifically, retaining member 52 is initially raised within first portion 100 of guide track 60 as represented in FIG. 4 such that guide element 76 moves beyond or out from first end 110 and pivot post 78 is unseated from the notch established by second end 111. At this point, retaining member 52 is rotated outward, followed by pivot post 78 traveling along second portion 102 until reaching second end 118. At this point, as shown in FIG. 5, retaining member 52 simply hangs substantially perpendicularly downward from shelf 19, allowing a consumer to readily retrieve any desired articles. To return retaining member 52 to the upright position, a consumer need merely reverse the above described process, shifting retaining member 52 along second portion 120 in order to allow guide element 76 to move back into first end 10 until pivot post 78 again rests in the notch defined by second end 111.

Figure 6:
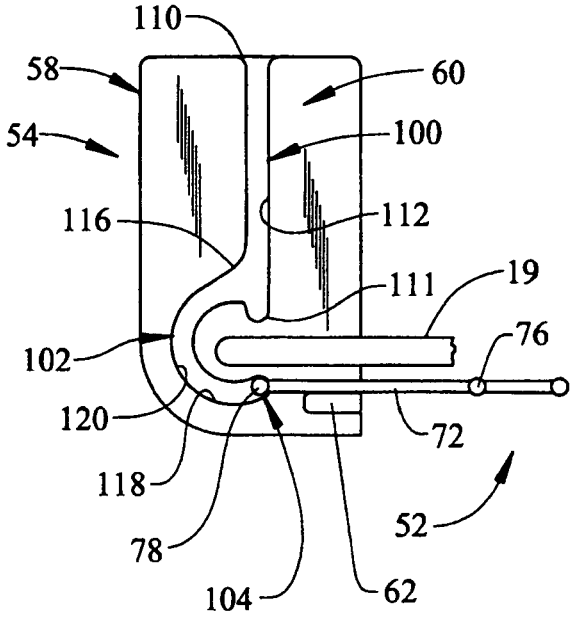
FIG. 6 is a side elevational view of one support bracket of the article retaining assembly of the first embodiment, illustrating the retaining member in a final or stowed position.

In the event that a consumer does not wish to utilize retainer assembly 50, retaining member 52 can be shifted to the third or stowed position as represented in FIG. 6. More specifically, in the manner described above, retaining member 52 is initially raised such that guide element 76 shifts out from first end 110 of first portion 100 and pivot element 78 shifts to a position adjacent first end 116 of second portion 102. At this point, retaining member 52 is rotated forward, with pivot post 78 traveling within second portion 102. However, instead of simply hanging downward at third end 118 as shown in FIG. 5, retaining member 52 is further shifted upward and rearward so as to be substantially coplanar with shelf 16 as represented in FIG. 6. At this point, side section 72 snaps over and abuts with holding element 62 to hold retaining member 52 in the stowed position.

Reference will now be made to FIGS. 7-12 in describing a second embodiment of the present invention. A shelf 19' includes opposing side sections 248 and 249 and a front edge section 250. Shelf 19' is provided with an article retainer assembly 50' that includes a retaining member 252 which extends across front edge section 250 of shelf 19'. Retaining member 252 is supported by first and second support brackets 254 and 256 which snap-fittingly connect to shelf 19'. As shown, first bracket 254 includes a main body portion 258 and an arcuate finger portion 260 extending therefrom. Finger portion 260 includes a guide track 262 formed therein. Additionally, main body portion 258 includes first, second and third tab portions 264-266 which extend substantially perpendicularly and laterally inward. Each tab portion 264-266 includes a respective flange portion 268-270. Furthermore, third tab portion 266 is provided with a lower holding element or clip 272 having a first retention channel 274. A second retention channel 276 is formed in an upper end (not separately labeled) of main body portion 258.

Figure 8:
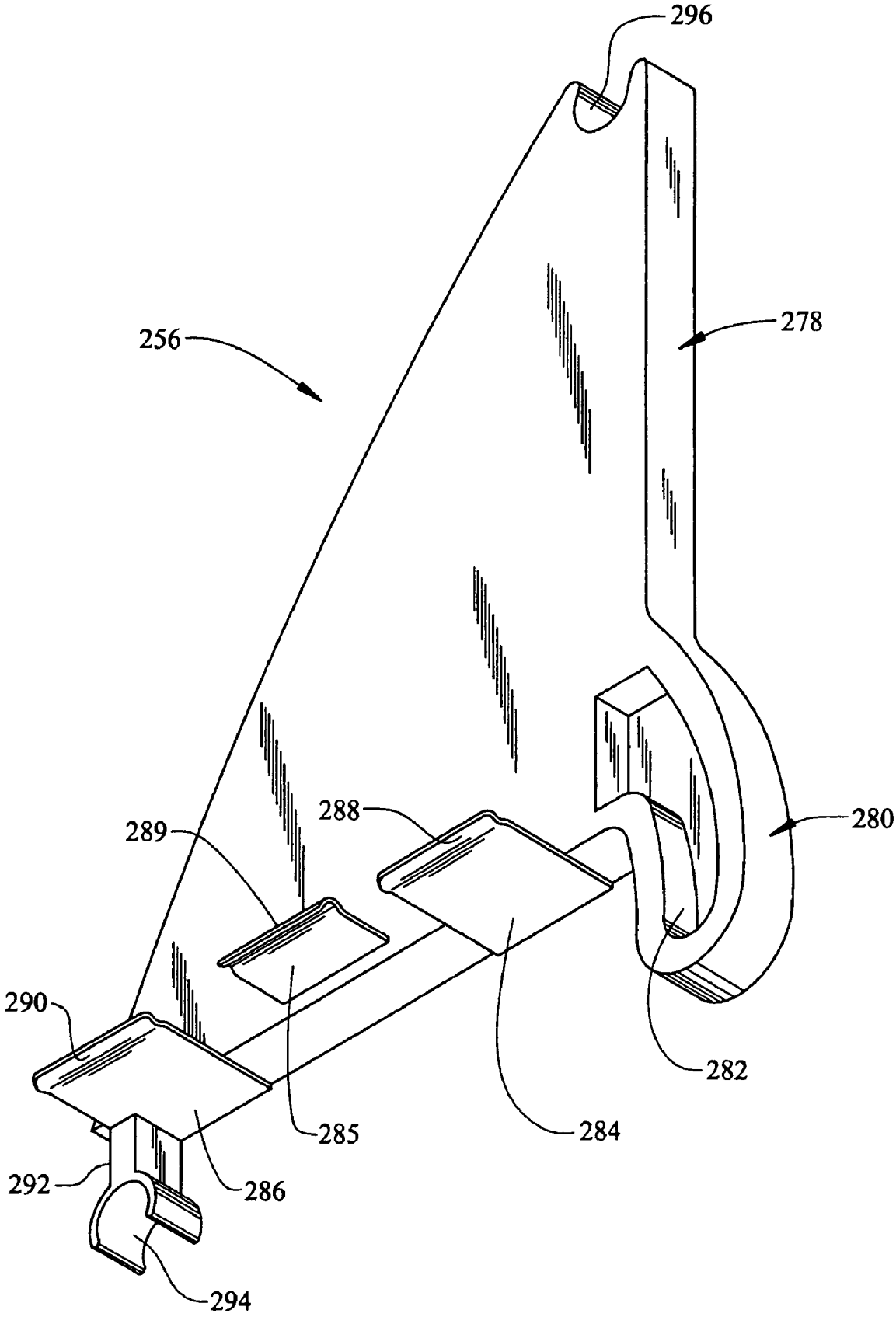
FIG. 8 is a perspective view of a support bracket of the article retaining assembly illustrated in FIG. 7.

As best shown in FIG. 8, second bracket 256 is essentially a mirror image of first bracket 254, including a main body portion 278 and an arcuate finger portion 280 having a guide track 282 formed therein. Additionally, second bracket 256 is provided with first, second and third inwardly, laterally projecting tab portions 284-286 each having a respective, terminal flange portion 288-290. In a manner similar to that described above, third tab portion 290 includes a holding element or clip 292 having a first retention channel 294, while a second retention channel 296 is located at an upper end (not separately labeled) of main body portion 278.

Shelf 19' is formed from a plurality of wire elements (not separately labeled). In addition, shelf 19' and retainer member 252 may include matching trim pieces, such as indicated at 298 and 299 in FIG. 7. Of course, it should be understood that shelf 19' could also be a solid, i.e., formed from plastic and/or glass. Regardless, first and second brackets 254 and 256 are designed to snap-fittingly clip to shelf 19'. At this point, it should be understood that, as first bracket 254 is essentially a mirror image of second bracket 256, the method of clipping brackets 254 and 256 to shelf 19' is essentially the same and thus will be discussed in reference to second bracket 256 with an understanding that first bracket 254 attaches to shelf 19' in a similar manner.

As illustrated in FIG. 8, tabs 284-286 extend from second bracket 256 in a staggered configuration. More specifically, tab 285 is located in an offset plane relative to tabs 284 and 286. This configuration enables a wire rung, for example rung 249, to be snap-fit between tab 285 and tabs 284, 286 to secure second bracket 256 to shelf 19'. Preferably, flange portions 288-290 of respective ones of tabs 284-286 are arcuately contoured so as to more robustly receive rung 249 and further aid in the retention of bracket 256.

Retaining member 252 is preferably formed from coated wire or molded plastic and includes a top section 302, a bottom section 304 and first and second opposing side sections 306 and 308. Additionally, retaining member 252 includes a first peg 310 that projects laterally outward from top section 302 beyond side section 306 and a first pivot post 312 that extends laterally outward from bottom section 304 beyond side section 306. Likewise, retaining member 252 includes a second peg 314 that projects laterally outward from top section 302 beyond side section 308, and a second pivot post 316 that extends laterally outward from bottom section 304 beyond side section 308. Pivot posts 312 and 316 respectively travel within guide tracks 262 and 282 of support brackets 254 and 256 in a manner that will be discussed more fully below.

Figure 7:
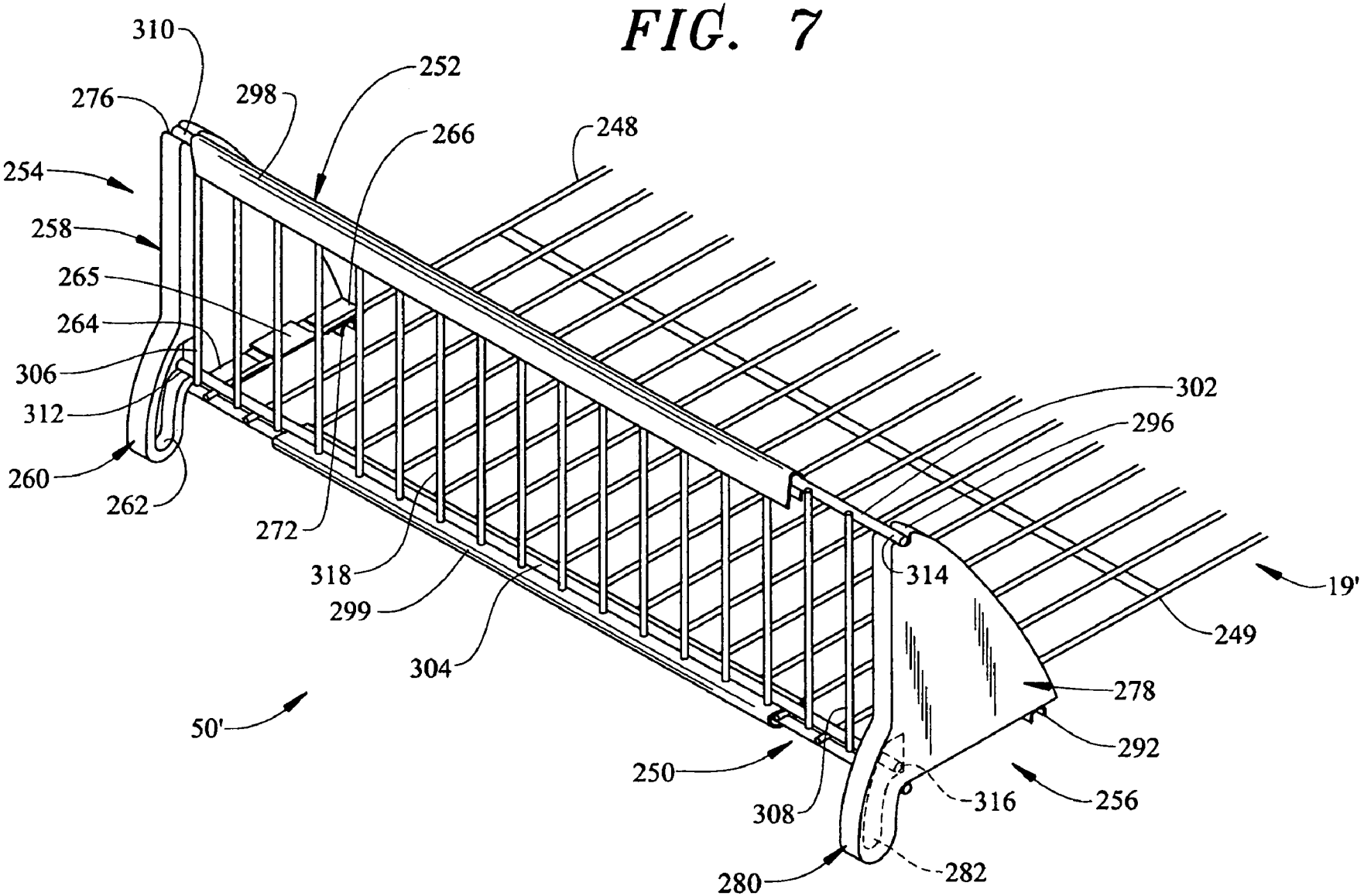
FIG. 7 is an upper left perspective view of an article retaining assembly constructed in accordance with a second embodiment of the present invention, illustrating first and second support brackets and a retaining member of the retaining assembly.
Figure 11:
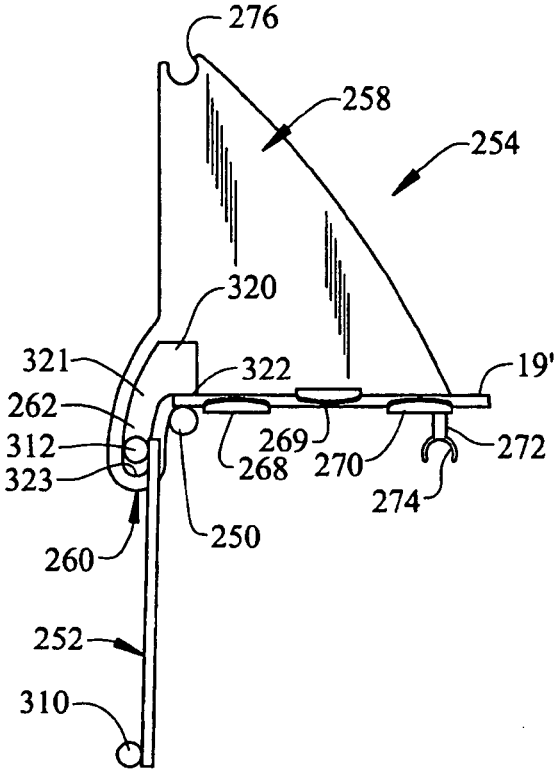
FIG. 11 is a side elevational view of the support bracket of the article retaining assembly of FIG. 7, illustrating the retaining member in the second or lowered position.
Figure 12:
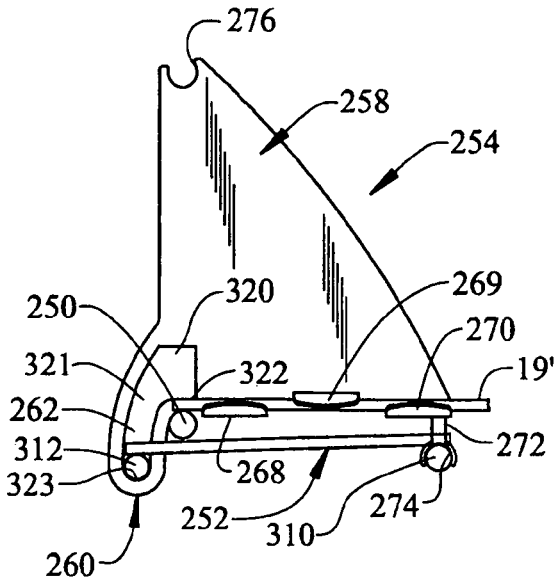
FIG. 12 is a side elevational view of the support bracket of the article retaining assembly of FIG. 7, illustrating the retaining member in a final or stowed position.

Retaining member 252 preferably includes a plurality of intermediate members, one of which is indicated at 318, that extend between and interconnect top and bottom sections 302 and 304. It should be understood that first and second pegs 310 and 314, pivot posts 312 and 316, and guide tracks 262 and 282 are respectively, similarly constructed such that a discussion will continue with respect to peg 310, pivot post 312 and guide track 262 with an understanding that peg 314, pivot post 316 and guide track 282 are similarly arranged. As shown, pivot post 312 nests within and, in a manner that will be discussed more fully below, transitions along guide track 262, allowing retaining member 252 to be selectively shifted between a first or upright position as represented in FIGS. 7 and 9, a second or lowered position as represented in FIG. 11, and a third or stowed position as represented in FIG. 12.

Reference will now be made to FIGS. 9-12 in describing a preferred construction of guide track 262. As shown, guide track 262 includes first and second offset portions 320 and 321 that establish a continuous pathway enabling retaining member 252 to transition between the first, second and third positions. First portion 320 is generally defined within main body portion 258 of bracket 254 and includes a bottom or support section 322. Second portion 321 is generally defined within arcuate finger portion 260 of bracket 258 and includes a bottom or support section 323.

Figure 9:
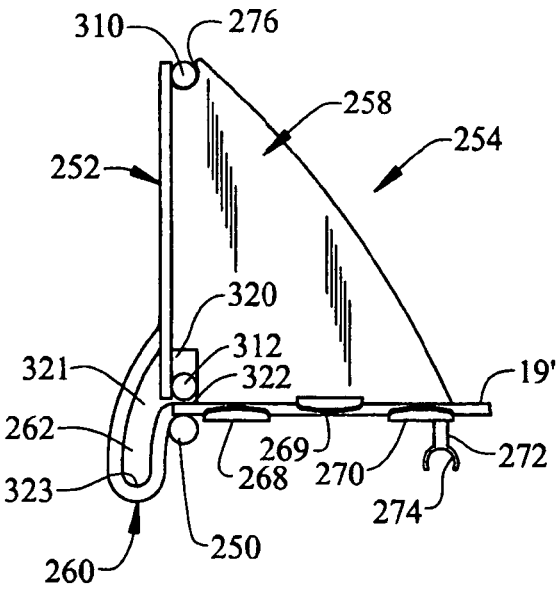
FIG. 9 is a side elevational view of one support bracket of the article retaining assembly of FIG. 7, illustrating the retaining member in a first or upright position.

Having described a preferred structure of article retaining assembly 50', reference will continue to FIGS. 9-12 in describing a preferred method of operation. As best shown in FIG. 9, retaining member 252 is shown in a first or upright position. In the upright position, retaining member 252 is arranged substantially perpendicular to, and slightly over, shelf 19'. In this position, retaining member 252 blocks or prevents articles resting upon shelf 19' from moving beyond front edge portion 250. In order to remove an article from shelf 19', a user would need to lift the article over retaining member 252 or retaining member 252 will need to be shifted from the upright position to the lowered or stowed positions.

Figure 10:
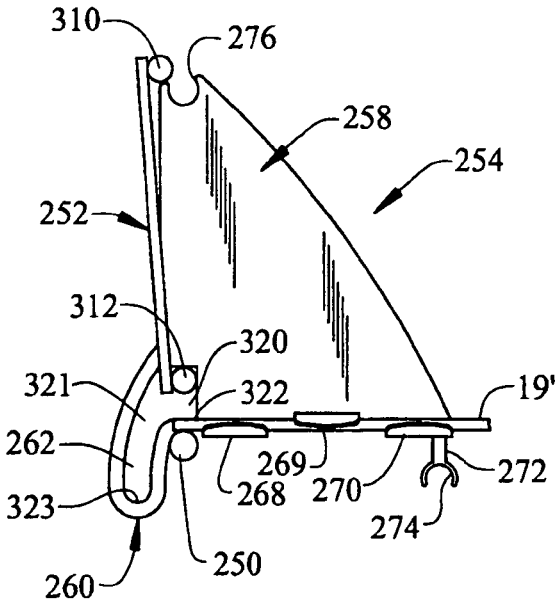
FIG. 10 is a side elevational view of the support bracket of the article retaining assembly of FIG. 7, illustrating the retaining member shifting towards a second or lowered position.

In order to shift retaining member 252 from the upright to the lowered position, retaining member 252 is raised, causing pivot post 312 to move upward within first portion 320 of guide track 262 until peg 310 is lifted out from second retention channel 276, as represented in FIG. 10. At this point, retaining member 252 is rotated outward, causing pivot post 312 to travel along second portion 321 of guide track 262. Once in the lowered position, pivot post 312 rests on bottom section 323 such as shown in FIG. 11. At this point, retaining member 252 simply hangs substantially perpendicularly downward relative to and below shelf 19', allowing a user to readily retrieve any desired articles. To return retaining member 252 to the upright position, the user need simply reverse the above described process, shifting retaining member 252 along second portion 321 of guide track 262 until pivot post 312 again rests on bottom support section 322 and peg 310 rests within second retention channel 276.

In the event that a user does not wish to utilize retainer assembly 50', retaining member 252 can be readily shifted to the third or stowed position as represented in FIG. 12. In a manner similar to that described above, retaining member 252 is initially shifted upward causing peg 310 to move from second retention channel 276. Once peg 310 has cleared second retention channel 276, retaining member 252 is rotated forward, with pivot post 312 rotating within guide channel 262. Retaining member 252 is then rotated/pivoted past the second position so as to be substantially parallel with shelf 19'. At this point, peg 310 is snap-fit into retention channel 274 of clip 272. In this position, retaining member 252 is thus held in place beneath shelf 19' until a user wishes to utilize retaining assembly 50', at which point the user simply disengages peg 310 from retention channel 274 and the above described process is reversed.

Based on the above description, it should be understood that the present invention provides for a unique, cost effective means of providing an article retainer assembly without the need to make structural changes to refrigerator 2. That is, support brackets 54 and 56 of the first embodiment can simply be mounted to opposing side walls of a refrigerator liner with, for example, adhesive or mechanical fasteners, and retaining member 52 supported there between. Alternatively, support brackets 254 and 256 of the second embodiment can be readily snapped onto existing refrigerator shelves and retaining member 252 supported therebetween. Thus, retaining assemblies 50 and 50' can be employed both as an initial production version and as an aftermarket add-on or retrofit feature for existing refrigeration appliances. Moreover, the present invention provides for an easy to use and readily re-positionable article retaining arrangement that can be employed by a user to prevent articles from shifting off of refrigerator compartment shelves or, if so desired, be stowed away for later use.

Although described with reference to preferred embodiments of the invention, it should be readily understood that various changes and/or modifications can be made to the invention without departing from the spirit thereof. For instance, although brackets are shown clipped to a wire refrigerator shelf, the brackets may clip onto a plastic or other types of shelves. In addition, the holding element may take on various forms, such as a spring element or the like. Furthermore, while shown in connection with a freezer shelf, the retaining assembly could also be employed in a fresh food compartment or, for that matter, on a door mounted shelf bin. In general, the invention is only intended to be limited by the scope of the following claims.

I claim:

1. A refrigerator comprising:

a cabinet;

a liner arranged within the cabinet, said liner having top, bottom and opposing side walls defining, at least in part, a refrigerated compartment;

a door pivotally mounted relative to the cabinet for selectively closing the refrigerated compartment;

a shelf mounted in the refrigerator compartment for supporting articles to be refrigerated, said shelf including a substantially flat planar portion defined, at least in part, by first and second opposing side sections and a front edge section; and an article retainer assembly including:

first and second support brackets mounted to the shelf, each of said first and second support brackets including a guide track; and a retaining member positioned across the front edge section of the shelf between the first and second support brackets, said retaining member including a main body portion having first and second end sections, each of said first and second end sections being provided with a pivot post extending into the guide track of a respective one of the first and second support brackets, said pivot post being adapted to transition along the guide track as the retaining member shifts between three distinct positions including a first position, wherein the retaining member extends above the front edge section of the shelf to block articles on the shelf, a second position wherein the retaining member is lowered to expose articles stored on the shelf, and a third, stowed position wherein the retaining member is maintained in a location assuring unobstructed access to articles stored on the shelf.

2. The refrigerator according to claim 1, wherein the guide track of each of the first and second support brackets includes a first portion interconnected to a second portion to define a continuous path.

3. The refrigerator according to claim 2, wherein the pivot post extending from each of the first and second end sections rests within the first portion of a respective said guide track when the retaining member is in its first position.

4. The refrigerator according to claim 1, wherein each of the first and second support brackets includes multiple tab portions, said first and second support brackets being secured to the shelf through respective ones of the multiple tab portions.

5. The refrigerator according to claim 4, wherein the multiple tab portions of each of the first and second support brackets snap-fittingly connect to the shelf.

6. The refrigerator according to claim 1, wherein at least one of the first and second support brackets includes a holding element for selectively maintaining the retaining member in the stowed position.

7. The refrigerator according to claim 6, further comprising:

first and second retention channels provided in the first and second support brackets respectively; and first and second pegs extending from the retaining member, each of the first and second pegs resting in a respective one of the first and second retention channels when the retaining member is in the first position.

8. The refrigerator according to claim 7, wherein the holding element is constituted by a clip, said clip being adapted to snap-fittingly receive one of the first and second pegs of the retaining member.

9. The refrigerator according to claim 1 wherein, when in the stowed position, said retaining member extends below and substantially parallel to the substantially flat planar portion of the shelf.

10. A refrigerator comprising:

a cabinet;

a liner arranged within the cabinet, said liner having top, bottom and opposing side walls defining, at least in part, a refrigerated compartment;

a door pivotally mounted relative to the cabinet for selectively closing the refrigerated compartment;

a shelf mounted in the refrigerator compartment for supporting articles to be refrigerated, said shelf including a substantially flat planar portion defined, at least in part, by first and second opposing side sections and a front edge section; and an article retainer assembly including:

a retaining member positioned across the front edge section of the shelf, said retaining member including a main body portion having first and second end sections, each of said first and second end sections being provided with a pivot post, said retaining member being shiftably mounted relative to the shelf to three distinct positions including a first position wherein the retaining member extends above the front edge section of the shelf to block articles on the shelf, a second position wherein the retaining member is lowered to expose articles stored on the shelf, and a third, stowed position wherein the retaining member is maintained in a location assuring unobstructed access to articles stored on the shelf; and means for supporting the retaining member in each of the first, second and third positions, said supporting means being mounted to the shelf.

11. The refrigerator according to claim 10, wherein the supporting means includes first and second support brackets mounted to the shelf, with each of the first and second support brackets including a guide track receiving a respective said pivot post.

12. The refrigerator according to claim 11, wherein each of the first and second support brackets includes multiple tab portions, said first and second support brackets being secured to the shelf through respective ones of the multiple tab portions.

13. The refrigerator according to claim 12, wherein the multiple tab portions of each of the first and second support brackets snap-fittingly connect to the shelf.

14. The refrigerator according to claim 11, further comprising:

first and second retention channels provided in the first and second support brackets respectively; and first and second pegs extending from the retaining member, each of the first and second pegs resting in a respective one of the first and second retention channels when the retaining member is in the first position.

15. The refrigerator according to claim 10, wherein the support means includes a holding element.

16. The refrigerator according to claim 15, further comprising: a peg extending from the retaining member, wherein the peg is snap-fittingly received by the holding element to selectively maintain the retaining member in the third position.

17. The refrigerator according to claim 10 wherein, when in the stowed position, the retaining member extends below and substantially parallel to the substantially flat planar portion of the shelf.

18. A method of operating an article retaining assembly provided across a front edge section of a refrigerator shelf comprising:

positioning a retaining member in a first position between first and second support brackets mounted to a refrigerator shelf to prevent articles from shifting beyond a front edge section of the refrigerator shelf;

lifting the retaining member, causing peg elements on the retaining member to disengage from retention channels on the first and second support brackets;

rotating the retaining member, causing pivot elements of the retaining member to transition along guide tracks defined by the first and second support brackets until the retaining member assumes a second, lowered position; and selectively stowing the retaining member in a third position wherein the retaining member is supported below and substantially parallel to the refrigerator shelf.

19. The method of claim 18, wherein the retaining member is snap-fittingly retained in the third position.

* * * * *